US005566845A

United States Patent [19]

Frank

[11] Patent Number: 5,566,845

[45] Date of Patent: Oct. 22, 1996

[54] CONTAINER HAVING A SEAL PUNCTURING DEVICE

[75] Inventor: Steven J. Frank, Havertown, Pa.

[73] Assignee: IDEA Laboratories, Inc., Wynnewood, Pa.

[21] Appl. No.: 382,451

[22] Filed: Feb. 1, 1995

[51] Int. Cl.[6] ..... B65D 50/02

[52] U.S. Cl. ..... 215/208; 215/228; 215/232; 215/297

[58] Field of Search ..... 215/228, 246, 215/222, 297, 251, 332, 208; 220/300, 297

[56] References Cited

U.S. PATENT DOCUMENTS

| | | | |
|---|---|---|---|
| 253,427 | 2/1882 | Renauld et al. | 215/332 X |
| 334,865 | 1/1886 | Howell | 215/332 X |
| 714,303 | 11/1902 | Hoffman | 215/332 |
| 2,771,218 | 11/1956 | Henderson | 222/83 |
| 3,074,592 | 1/1963 | Stocking | 220/51 |
| 3,094,155 | 6/1963 | Taramasso et al. | 141/329 |
| 3,109,562 | 11/1963 | Ferris | 222/81 |
| 3,339,812 | 9/1967 | Meissner | 222/566 |
| 3,390,677 | 7/1968 | Razimbaud | 128/214 |
| 3,422,977 | 1/1969 | Shaw | 215/208 |
| 3,451,576 | 6/1969 | Lewis | 215/208 X |
| 3,581,605 | 6/1971 | Taylor | 215/297 X |
| 3,749,270 | 7/1973 | Affleck | 215/222 |
| 3,824,815 | 7/1974 | Darling | 215/208 X |
| 4,137,930 | 2/1979 | Scolle | 137/68 R |
| 4,724,973 | 2/1988 | Shah | 215/246 |
| 4,770,305 | 9/1988 | Su | 215/250 |
| 4,793,503 | 12/1988 | Towns et al. | 215/250 |
| 4,957,210 | 9/1990 | Kusz | 215/246 X |
| 5,292,018 | 3/1994 | Travisano | 215/246 |

FOREIGN PATENT DOCUMENTS

| | | |
|---|---|---|
| 1345042 | 10/1963 | France . |
| 1525241 | 5/1968 | France . |
| 0498868 | 6/1930 | Germany . |
| 1432169 | 4/1969 | Germany . |
| 0531816 | 8/1955 | Italy . |
| 0555804 | 1/1957 | Italy . |
| 0689814 | 4/1965 | Italy . |
| 0772920 | 4/1957 | United Kingdom . |

*Primary Examiner*—Allan N. Shoap
*Assistant Examiner*—Robin A. Hylton
*Attorney, Agent, or Firm*—John A. Parrish

[57] ABSTRACT

The invention provides a device for puncturing a sealed container, and a container which includes that device. The puncture device includes a body member for releasable attachment to the container over a seal on the container, and a puncture member for puncture of the seal. The invention provides child resistant, tamper-proof containers which can easily be opened by handicapped adults and the elderly.

8 Claims, 9 Drawing Sheets

CONTAINER HAVING A SEAL PUNCTURING DEVICE

FIELD OF THE INVENTION

The invention relates to devices for puncturing sealed containers and to sealed containers which include those devices.

BACKGROUND OF THE INVENTION

It is known that the contents in containers such as pharmaceutical containers are secured against tampering by providing a thin seal of a material such as paper or metal over the opening of the container. A closure member such as a cap is joined to the container over the sealed opening. It is also known that a security tape is provided around the joint of the cap and the container to discourage tampering with contents of the container. When desiring access to the contents in the container, the tape and the cap are removed and the seal is thereafter punctured or removed. Removal of the cap, however, can be difficult for the elderly, impaired and the handicapped who lack manual dexterity. This is particularly true with caps designed to be child-resistant.

Various devices have been used to puncture the sealed openings of containers. These devices vary from sharp instruments such as spikes and blades to blunt instruments such as rods and human fingers. Elderly and handicapped consumers who lack manual dexterity, however, may not be able to employ their fingers to puncture the seal. These consumers may also lack sufficient manual dexterity to employ devices such as spikes to puncture the sealed opening.

A need therefore exists for a seal puncturing device that overcomes the deficiencies of the prior art. A further need exists for sealed containers which can easily be opened by the elderly and the handicapped but which are tamper-proof and child-resistant.

SUMMARY OF THE INVENTION

The invention provides a puncture device for puncturing the sealed opening of a container, and a container which includes the puncture device. The puncture device employs a body member having a slot arrangement therein to releasably engage a post member on a container. In one aspect, the slot arrangement is L-shaped. In a child-resistant aspect, the slot arrangement includes a plurality of intersecting vertical and horizontal slots. The body member is adapted to releasably engage the container over the sealed opening of the container. The body member includes a puncture member for puncturing a seal provided on the opening of the container. In a tamper-proof aspect, the container is shrink-wrapped with a heat shrinkable plastic. The invention advantageously provides a sealed container which can readily be opened by the elderly and handicapped but yet is tamper-proof and child-resistant.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, like numerals indicate like elements throughout.

DETAILED DESCRIPTION OF THE INVENTION

Figure 1A:
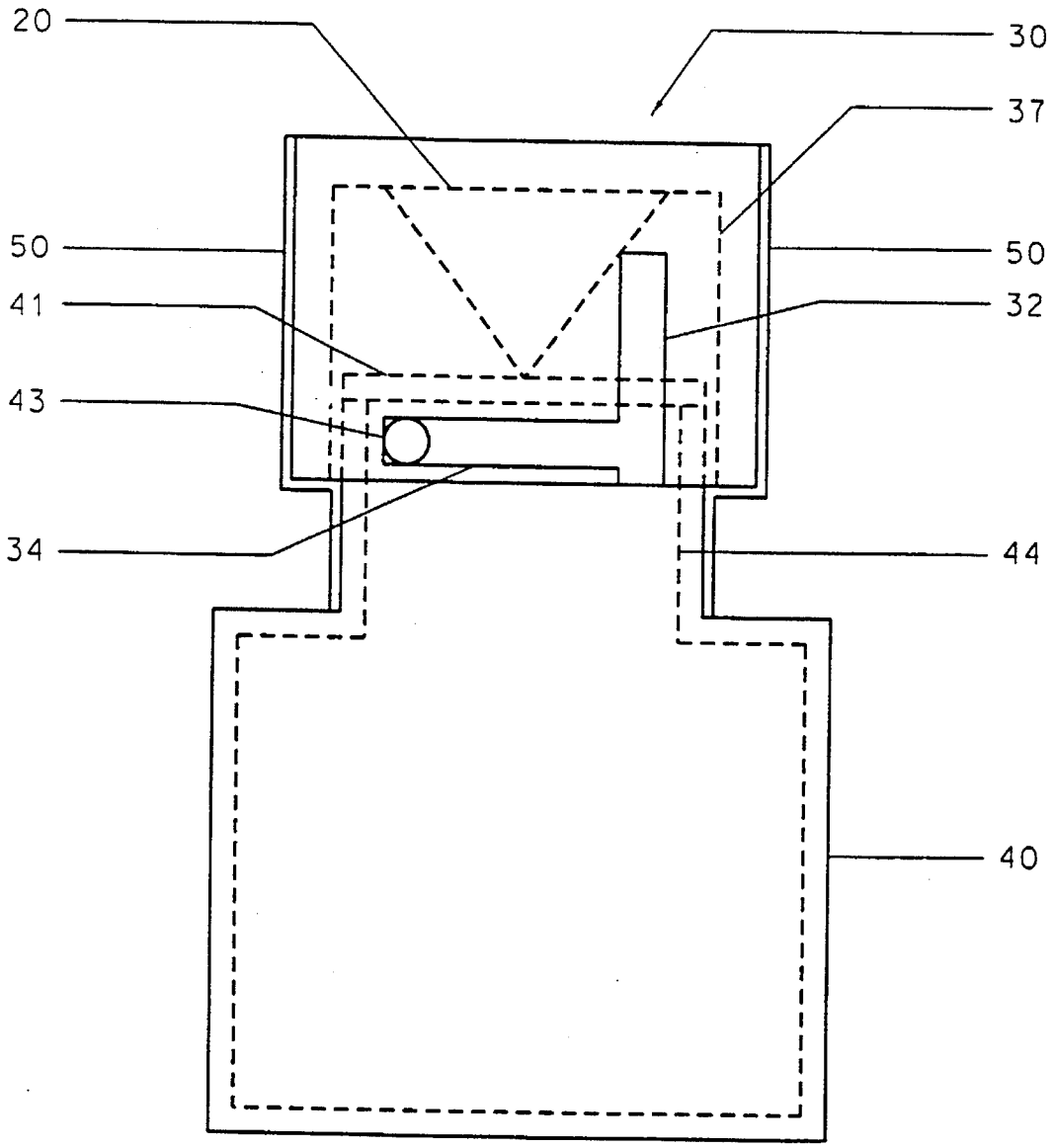
FIG. 1*a* is an elevational view of sealed container that includes a seal puncture device where the seal puncture device is in a secured position prior to puncture of the seal.
Figure 1B:
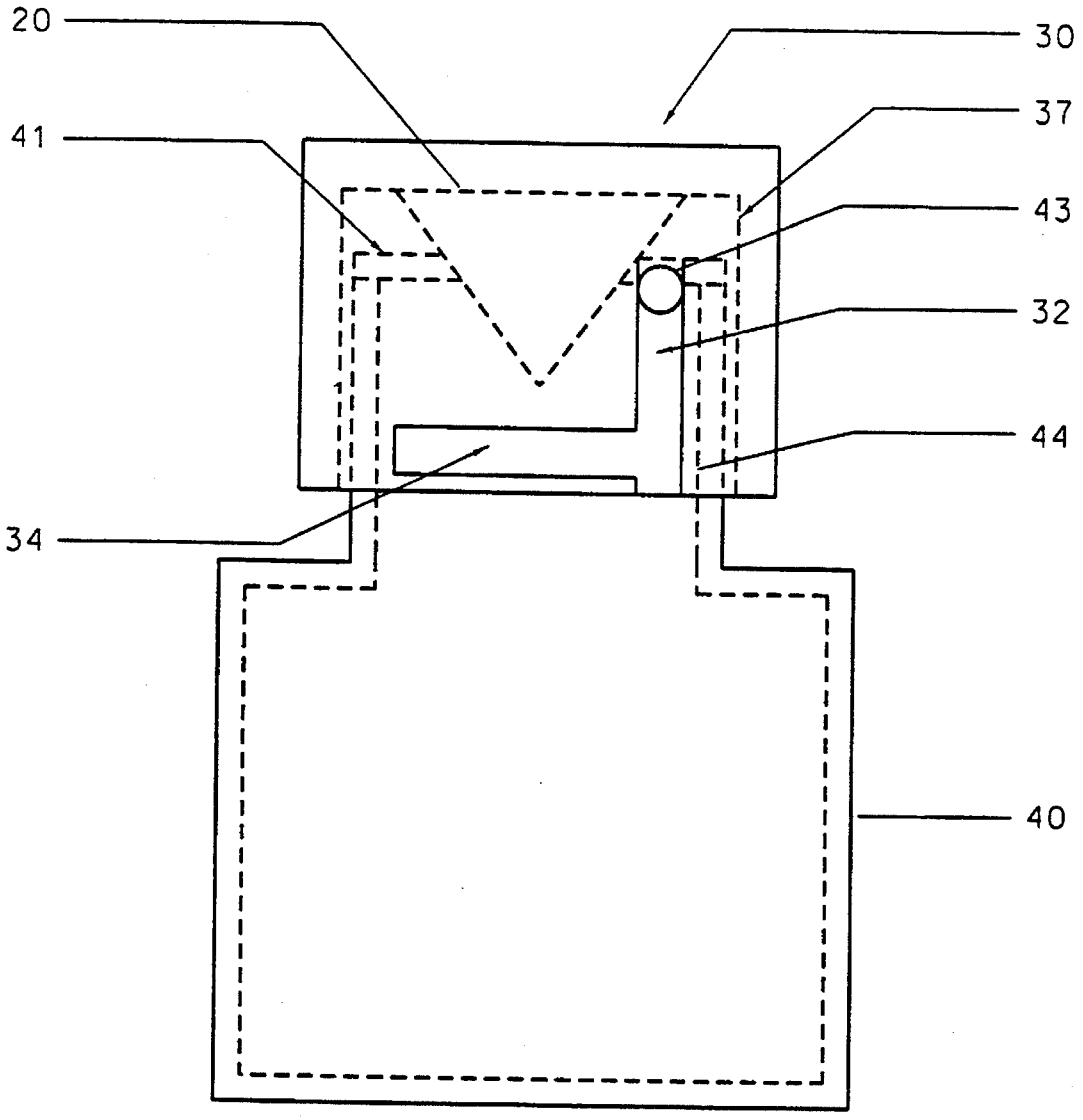
FIG. 1*b* is an elevational view of the container of FIG. 1*a* showing the position of the seal puncturing device after puncture of the seal.
Figure 1C:
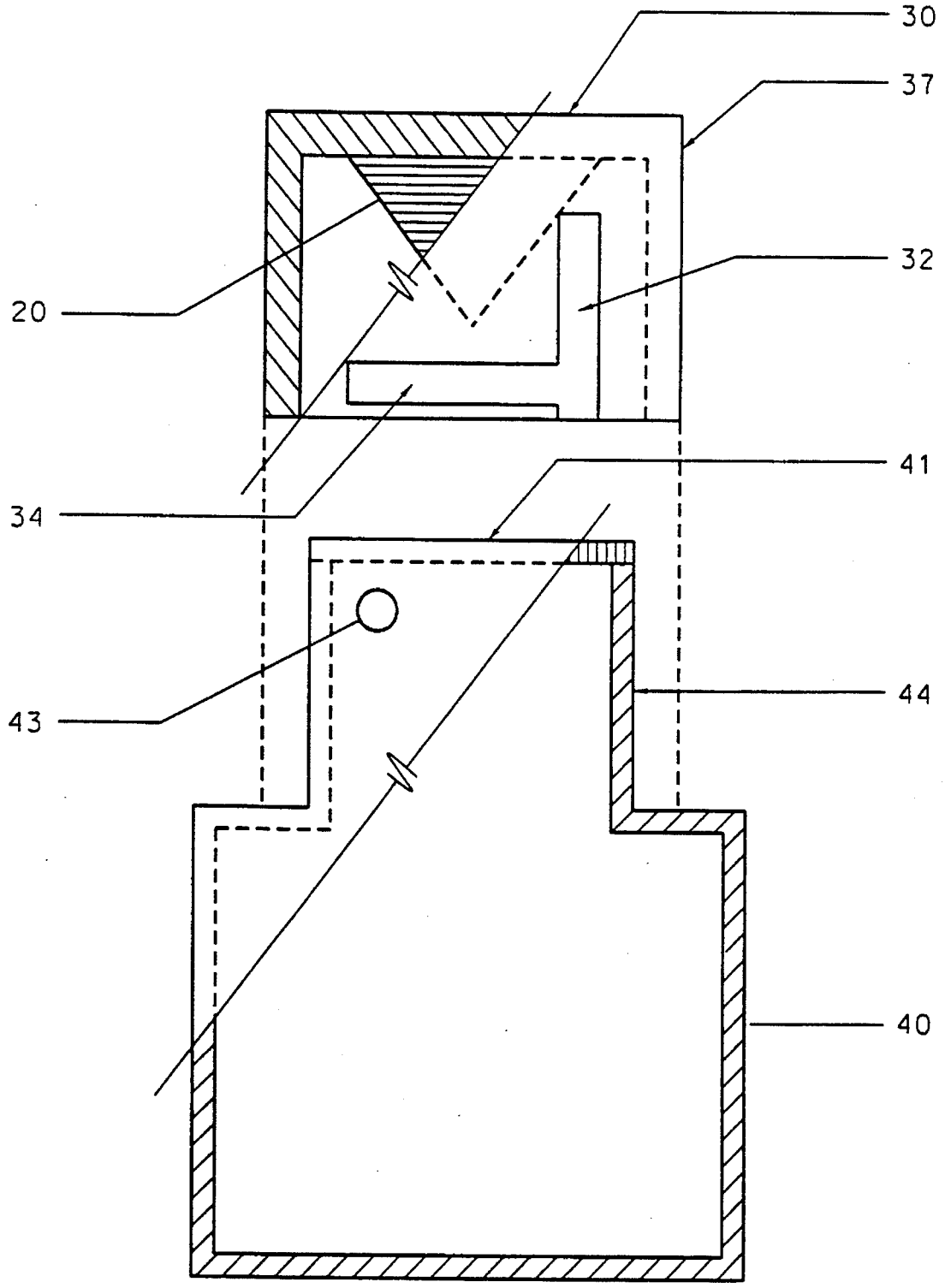
FIG. 1*c* is an exploded, partial cross-sectional view of the container and seal puncture device of FIG. 1*a;*

In a first aspect, the invention provides sealed, tamper-proof containers which can be readily opened by the handicapped and the elderly who lack manual dexterity. As shown in FIGS. 1*a*–1*c*, seal puncture device 30 comprises puncture member 20 and body member 37. Puncture member 20 can have the shape of a cone suitable for puncturing seal 41 as shown in FIG. 1*b*. Puncture member 20 also may have the shape of, for example, chisel-shaped blades, crossed pointed blades, and the like. Body member 37 can be molded from plastics such as polyethylene, polypropylene and the like by well-known methods such as injection molding. Body member 37 also can be made from metals such as stainless steel, aluminum and the like.

Body member 37 can be in the form of a cap adapted to fit container 40 by a post-in-slot attachment as shown in FIG. 1*a*. Body member 37 may be provided with roughened surfaces (not shown) to facilitate gripping thereof. The top surface of body member 37 typically has a thickness sufficient to be impervious to needles of hypodermic syringes.

FIG. 1*a* shows body member 37 in a secured position on neck 44 of container 40 over seal 41 which preferably is secured around its periphery to container 40 to form a hermetic barrier to the contents within container 40. This secured position can be maintained by security wrap 50 to prevent accidental puncture of seal 41 or tampering with the contents of container 40. Security wrap 50 can be formed from well known transparent or substantially transparent plastics. Preferably, security wrap 50 is a well known heat shrinkable plastic which is shrink wrapped onto at least the joint region between body member 37 and neck 44 of container 40. More preferably, security wrap 50 is shrink-wrapped over the entire surface of container 40. Well known methods can be employed to shrink wrap the plastic to form security wrap 50.

As shown in FIGS. 1*a*–1*c*, body member 37 is joined to container 40 by a post-in-slot attachment. As more clearly shown in FIG. 1*b*, slot portions 32 and 34 of body member 37 can move over post 43 of container 40 to cause puncture member 20 to puncture seal 41. Post 43 preferably is a rigid member of the same composition as container 40. After puncture of seal 41, and when access to the contents of container 40 is desired, body member 37 is removed from container 40 by guiding slot 32 upwardly around post 43. After accessing container 40, body member 37 can be rejoined to container 40 by causing slot 32 to move downwardly around post 43 to engage slot 34. Body member 37 then is rotated to cause slot 34 to move over post 43 to secure body member 37 to container 40 as shown in FIG. 1*a*. Re-joining of body member 37 to container 40 advantageously enables body member 37 to function as a removable cap to maintain the contents of container 40 in a sanitary condition.

Figure 2A:
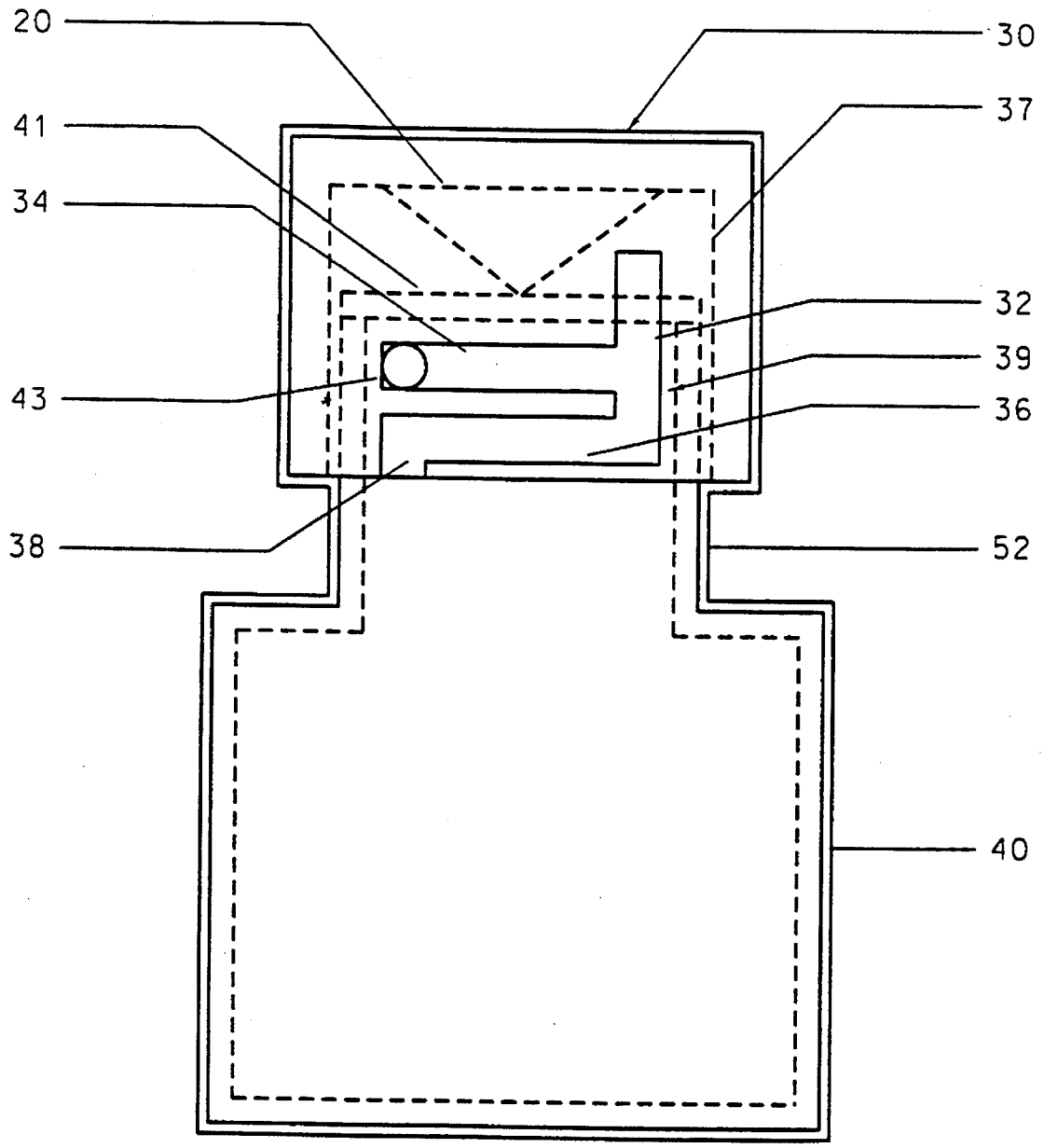
FIG. 2*a* is an elevational view of a sealed, child-resistant container that includes a puncture device having a slot arrangement of a plurality of intersecting horizontal and vertical slots where the puncture device is in a secured position.
Figure 2B:
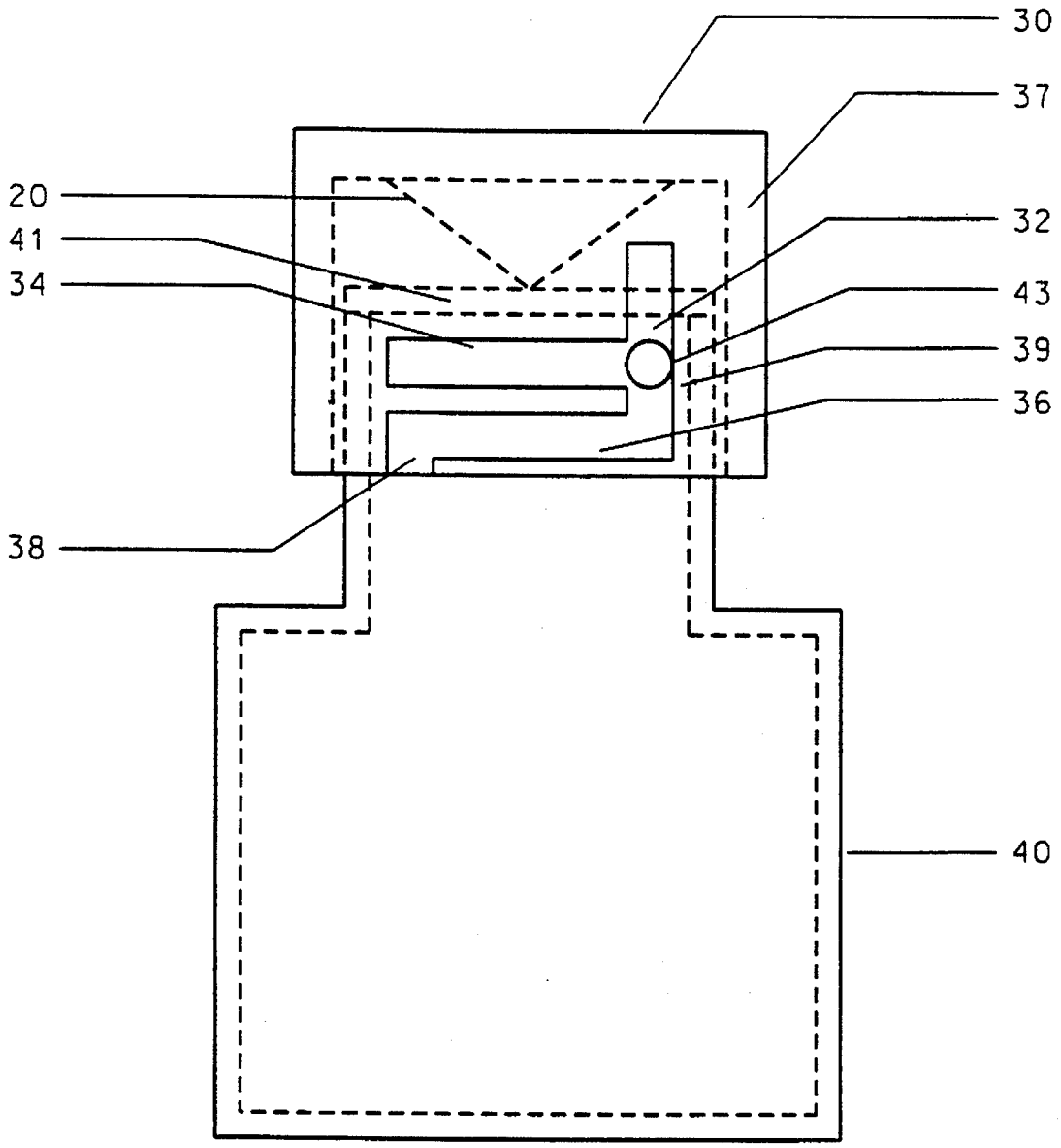
FIG. 2*b* is an elevational view of the container of FIG. 2*a* showing the position of the seal puncturing device just prior to puncture of the seal of the container.
Figure 2C:
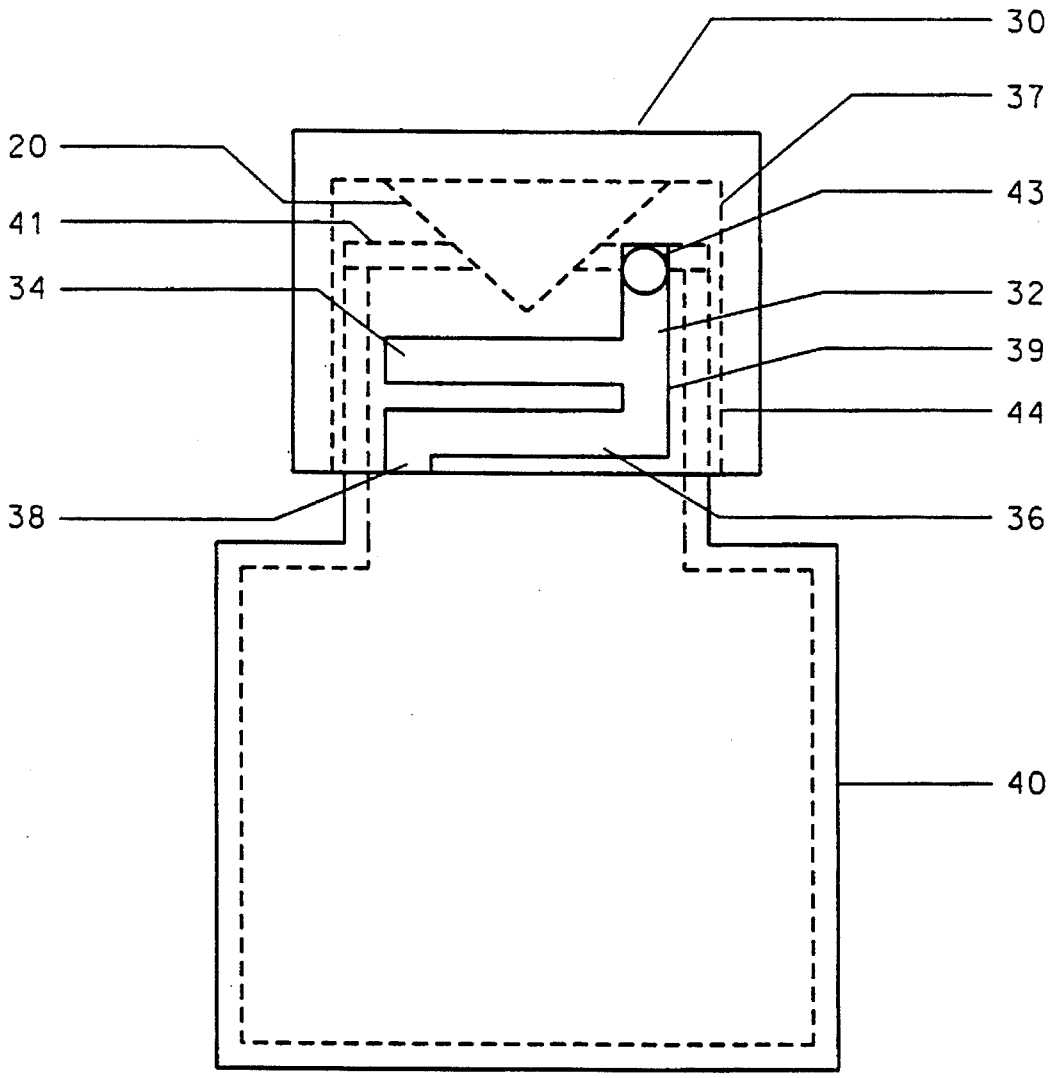
FIG. 2*c* is an elevational view of the container of FIG. 2*a* showing the position of the seal puncture device after puncture of the seal of the container.

In a further aspect, and as shown in FIGS. 2*a*–2*f*, the invention provides child resistant, tamper-proof containers which can easily be opened by the handicapped and the elderly. In this aspect, as shown in FIG. 2a, seal puncture device 30 is in a secured position on container 40 prior to puncture of seal 41. Puncture device 30 includes body member 37 having arrangement slot 39 of a plurality of intersecting horizontal and vertical slots. The slot arrangement 39, as shown in FIG. 2*a*, preferably comprises first vertical slot 28 and second vertical slot 32 as well as lower horizontal slot 36 and distal horizontal distal slot 34 that intersects the second vertical slot 32. Distal slot 34 has a closed end portion to retain puncture device 30 in a predetermined position during vertical movement of device 30 relative to container 40. Shrink wrap 52, formed of well-known transparent or substantially transparent heat shrinkable plastic, preferably is provided over container 40 having seal puncture device 30 thereon. Well-known methods can be employed to form shrink wrap 52 slot arrangement 39 includes slot portions 32', 34', 36 and 38. When intending to puncture seal 41, shrink wrap 52 is removed and body member 37 rotated to cause slot portion 34' to move over post 43 whereby post 43 engages slot portion 32' of slot arrangement 39 as shown in FIG. 2*b*. Thereafter, body member 37 is moved downwardly to cause slot portion 32' to move over post 43 as shown in FIG. 2c whereby puncture member 20 punctures seal 41.

Figure 2D:
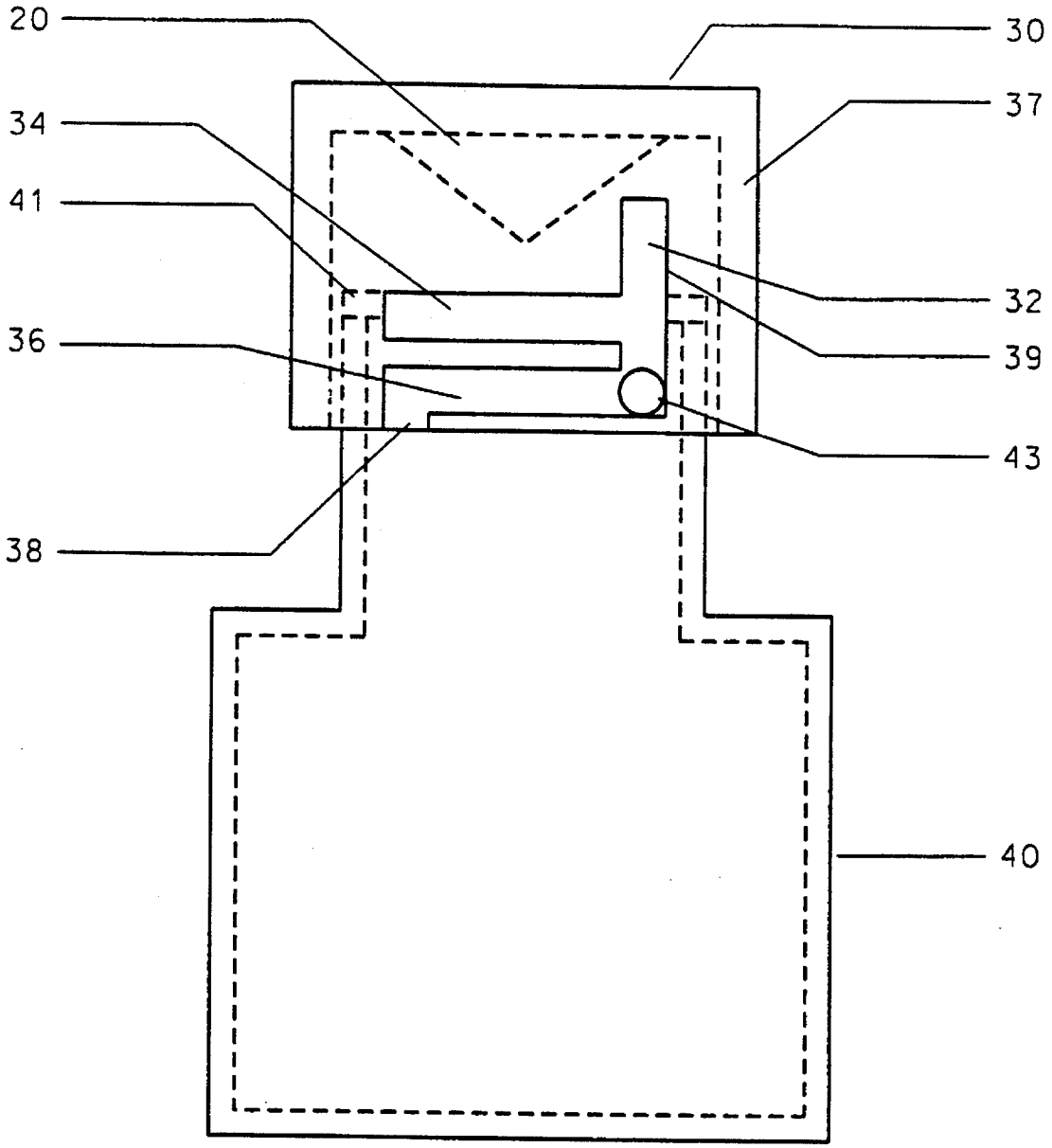
FIGS. 2*d* and 2*e* are elevational views of the container of FIG. 2*a* showing the puncture device prior to removal from the container.
Figure 2E:
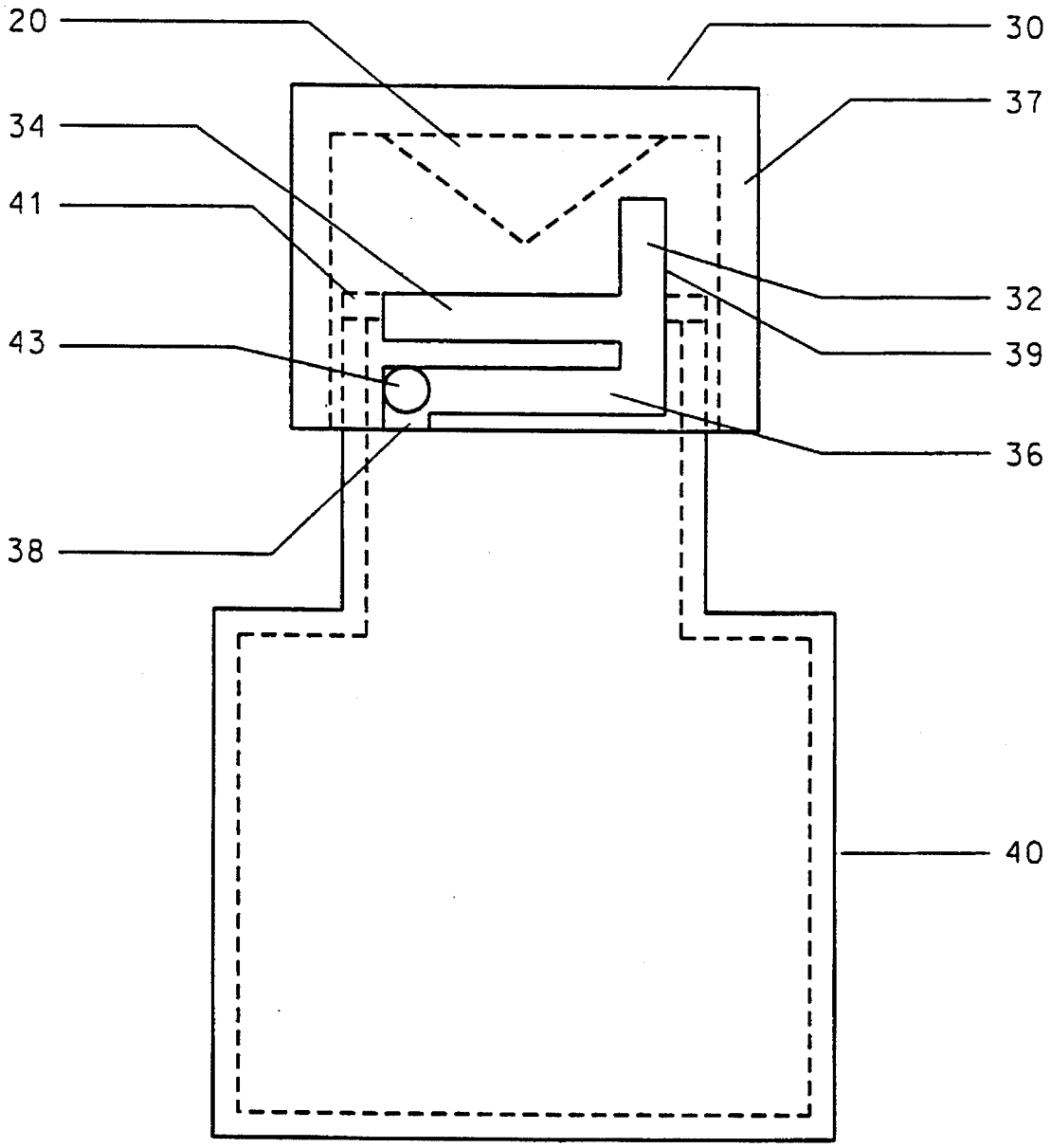
Figure 2F:
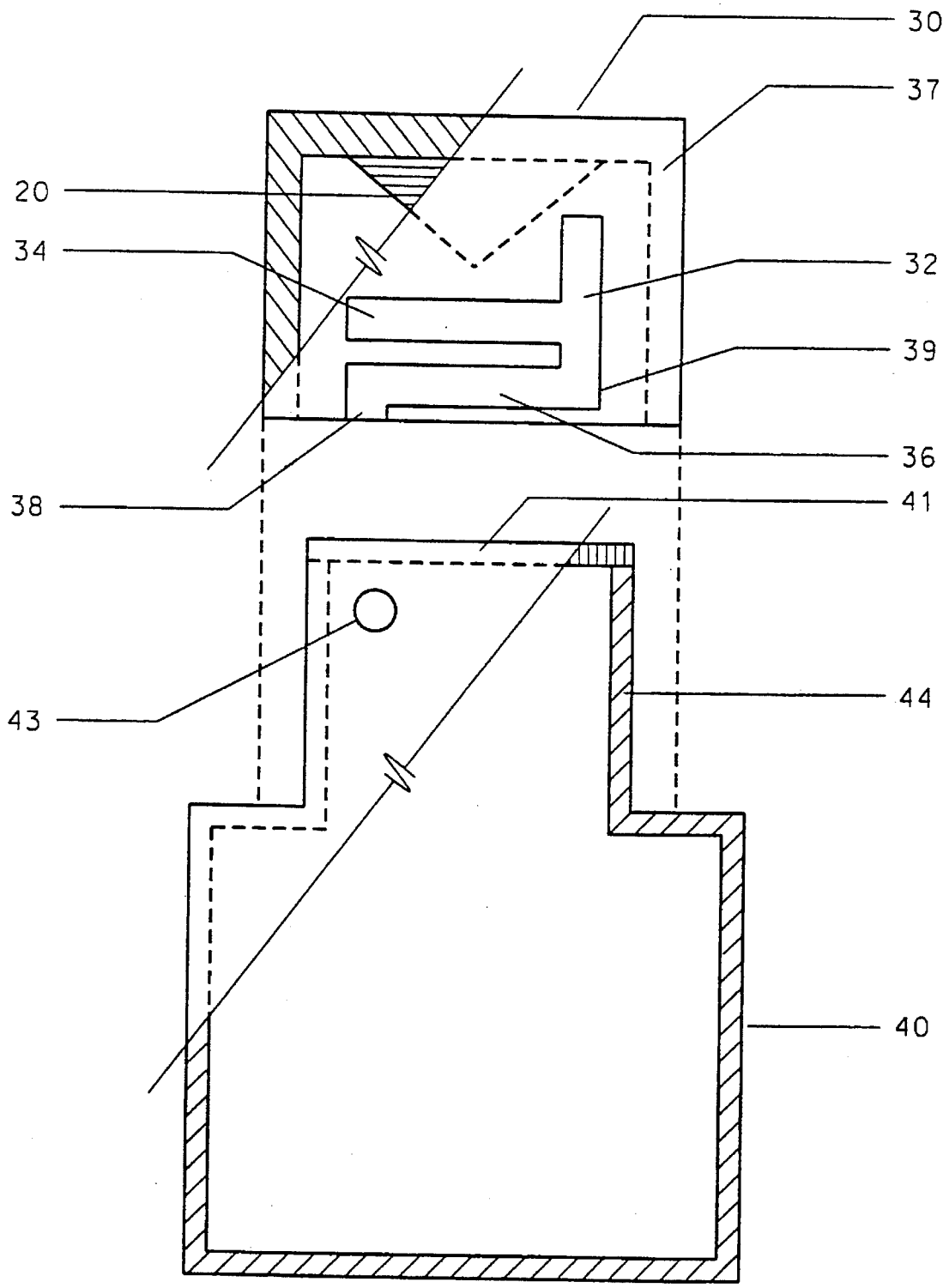
FIG. 2*f* is an exploded, partial cross-sectional view of the container and seal puncture device of FIG. 2*a*.

After seal 41 has been punctured, body member 37 is removed from container 40 by moving body member 37 upwardly to cause post 43 to engage slot portions 36 and 38 as shown in FIGS. 2*d* and 2*e*. Body member 37 can be rejoined to container 40 by reversing the sequence of movements of body member 37 which were employed to remove body member 37 from container 40. Although the movements required to guide post 43 through slot portions 32', 34', 36 and 38 should not be difficult for handicapped or elderly adults, it is expected that children, should have substantial difficulty in guiding post 43 through those slot portions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A closure for a container member having an opening for receiving flowable material therein, said closure comprising:

a hollow body member having means for engaging and closing a container member over an opening in said container member for receiving flowable material into said container, said body member having an upper surface and a lower edge, said body member having a slot arrangement for engaging a post member on said container member to releasably attach the body member to the container member, said slot arrangement comprising a plurality of vertical slots and a plurality of horizontal slots intersecting said vertical slots, said plurality of vertical slots including first and second parallel vertical slots, said plurality of horizontal slots including first and second parallel horizontal slots, said first vertical slot intersecting said edge of said body member and said first horizontal slot, said first horizontal slot intersecting said first and second vertical slots, said second horizontal slot intersecting said second vertical slot, said second vertical slot extending above said second horizontal slot, said second horizontal slot having a closed end portion to retain said body member in a predetermined vertical position relative to said container member.

2. A container having a device for puncturing a seal on the container, comprising, in combination:

a container member having an opening and a seal over said opening, a body member for engaging and closing the container over the opening, the body member having a lower edge and an upper surface, and a slot arrangement for enabling said body member to engage a post member on the container member, said body member having a puncture member for puncturing the seal, said slot arrangement comprising a plurality of vertical slots and a plurality of horizontal slots intersecting said vertical slots, said plurality of vertical slots including first and second parallel vertical slots said slots, said plurality of horizontal slots including first and second parallel horizontal slots, said first vertical slot intersecting said edge of said body member and said first horizontal slot, said first horizontal slot intersecting said first and second vertical slots, said second horizontal slot intersecting said vertical slot, said second vertical slot extending above said second horizontal slot, said second horizontal slot having a closed end portion to retain said body member in a predetermined vertical position relative to said container member.

3. The container of claim 2 wherein said puncture member is a cone.

4. The container of claim 2 wherein said body member is a cap.

5. The container of claim 2 further comprising a layer of shrink-wrapped plastic on at least a portion of the container.

6. A child resistant container for receiving flowable material therein comprising, in combination:

a container member having a post member and an opening for receiving flowable material therein, a body member for engaging and closing the container over the opening, the body member having a lower edge and an upper surface, and a slot arrangement for enabling said body member to engage the post member on container member, said slot arrangement comprising a plurality of vertical slots and a plurality of horizontal slots intersecting said vertical slots, said plurality of vertical slots including first and second parallel vertical slots, said plurality of horizontal slots including first and second parallel horizontal slots, said first vertical slot intersecting said edge of said body member and said first horizontal slot, said first horizontal slot intersecting said first and second vertical slots, said second horizontal slot intersecting said second vertical slot, said second vertical slot extending above said second horizontal slot, said second horizontal slot having a closed end portion to retain said body member in a predetermined vertical position relative to said container member.

7. The container of claim 6 further comprising a seal member over said opening.

8. The container of claim 7 wherein said body member further comprises a puncture member for puncturing said seal member.

* * * * *